US005823104A

United States Patent [19]

Beisel et al.

[11] Patent Number: 5,823,104

[45] Date of Patent: Oct. 20, 1998

[54] PRESS FOR COLD WORKING OF METAL WORKPIECES

[75] Inventors: Winfried Beisel, Wilnsdorf-Obersdorf; Eckehart Schulze, Weissach; Heinz Groos, Netphen; Dieter Budenbender, Siegen; Hans-Werner Kutscher, Braunschweig, all of Germany

[73] Assignee: Grabener Pressensysteme GmbH & Co., KG, Netphen, Germany

[21] Appl. No.: 718,517

[22] PCT Filed: Mar. 25, 1995

[86] PCT No.: PCT/EP95/01138

§ 371 Date: Oct. 30, 1996

§ 102(e) Date: Oct. 30, 1996

[87] PCT Pub. No.: WO95/27615

PCT Pub. Date: Oct. 19, 1995

[30] Foreign Application Priority Data

Apr. 9, 1994 [DE] Germany ..... 44 12 224.1

[51] Int. Cl.[6] ..... B30B 15/16; B30B 15/04; B30B 1/32

[52] U.S. Cl. ..... 100/48; 72/19.9; 72/21.5; 72/427; 72/453.07; 100/218; 100/269.09; 100/269.14; 100/269.17

[58] Field of Search ..... 100/43, 48, 50, 100/214, 218, 269.05–269.09, 269.14, 269.17; 72/19.9, 21.5, 453.06, 453.07, 427

[56] References Cited

U.S. PATENT DOCUMENTS

| | | | |
|---|---|---|---|
| 3,138,976 | 6/1964 | Robra | 100/48 |
| 3,196,647 | 7/1965 | Schneider | 100/43 |
| 3,205,790 | 9/1965 | Bollar | 72/19.9 |
| 4,098,105 | 7/1978 | Fullers et al. | 100/48 |
| 4,127,019 | 11/1978 | Vasilkovsky et al. | 100/48 |
| 4,831,861 | 5/1989 | Hofmann et al. | 72/453.07 |

FOREIGN PATENT DOCUMENTS

| | | | |
|---|---|---|---|
| 0339247 | 11/1989 | European Pat. Off. | 72/453.07 |
| 4037848 | 6/1992 | Germany | 72/453.06 |
| 2124800 | 2/1984 | United Kingdom | 72/453.06 |

*Primary Examiner*—Stephen F. Gerrity
*Attorney, Agent, or Firm*—Antonelli, Terry, Stout & Kraus, LLP

[57] ABSTRACT

The invention is a press for cold working of metal workpieces. The invention includes a double-acting linear hydraulic power drive cylinder, a continuous press frame for accepting reactive forces that develop during the operation of the press, and a control valve system operable by output signals, and being one of program-controlled or manually triggerable, from an electronic control unit, for controlling motion of a piston of the drive cylinder.

28 Claims, 6 Drawing Sheets

PRESS FOR COLD WORKING OF METAL WORKPIECES

BACKGROUND OF THE INVENTION

1. Field of the Invention

The invention relates to a press for cold working of metal workpieces, said workpieces being intended to be given a shape with close tolerances by embossing, deep-drawing, extruding, calibrating, hobbing, or precision-cutting machining, especially a coin or medal embossing press for embossing coins or medals with high surface quality.

2. Description of the Prior Art

Presses having a hydraulic-powered drive and a double-acting linear hydraulic cylinder for example, that can develop shaping forces between $10^6$ and $10^8$N, are generally known and described in detail for example in the scientific and technical textbook "Staten und Pressen" [Upsetting and Pressing] by Billigmann/Feldmann, Karl Hanser Verlag, Munich 1973, second edition, pages 352 et seq.

In the usual design of such presses, with the working area mounted at the approximate height of an operator's chest for both design and ergonomic reasons, the drive cylinder with whose piston the upper tool of the press, an embossing punch for example, is firmly and releasably connected by its tool holder, is located above the working area, while the lower tool that acts as a counterbearing for the workpiece to be machined is mounted on a tool holder that defines the working area at its underside, said holder forming the counterbearing for the workpiece to be cold worked.

The press frame, which must accept the reactive forces that develop during the shaping operation of the press with a degree of intrinsic deformation that is as small as possible, is usually designed as a frame that is self-contained and whose basic shape is rectangular, said frame comprising a yoke on the drive side, a yoke on the counterbearing side, and lateral cheeks connecting said yokes, with the drive cylinder being mounted inside the frame on the underside of the yoke on the drive side, and the tool holder for the lower tool being supported axially on the lower yoke of the press frame on the counterbearing side.

One disadvantage of the known design of hydraulically driven presses as explained above is the relatively large lateral extent of the press frame, measured at right angles to the central lengthwise axis of the driving hydraulic cylinder, with the cheeks of said frame, projecting laterally on the driving hydraulic cylinder housing, having to be located a relatively long distance from one another, so that significant bending moments develop in the areas of both the drive-side yoke and the counterbearing-side yoke of the press frame as well as in the cheeks that connect the two yokes, said moments being resisted only by appropriate increases in the cross sections of the yokes. The cheeks also undergo considerable elastic elongation under the influence of the press forces, said elongation resulting in additional energy consumption because a considerable portion of the installed power is required to pretension the press frame so that the press forces can be transmitted to the workpiece.

When presses of the known design are used to emboss coins, said coins being intended to have a constant thickness, this goal is accomplished by limiting the impact with the aid of fixed stops, which must be adjusted precisely, located on both sides of the embossing area but with additional lateral space being required as a result of such stops being provided, requiring a corresponding widening and reinforcement of said press frame.

For adjusting the stops to a preset thickness of coins whose embossing also requires a specified minimum force, time-consuming adjustment and embossing tests are required before continuous embossing operation can begin.

SUMMARY OF THE INVENTION

Hence, the goal of the invention is to improve a press of the species recited at the outset in such fashion that, assuming that the press is designed for a specific maximum press force, the press frame is subjected to smaller axial and lateral deformations during press operation with a design that is nevertheless lighter and less bulky, and that it also permits, in addition to pressure-controlled operation without requiring fixed stops, precise travel-controlled operation over a wide range of usable press forces.

As a result of the structural integration of the driving hydraulic cylinder into the press frame a housing, whose basic shape is circularly cylindrical, and a yoke on the drive side of the press frame, together with the circumferential areas of its jacket, form portions of the cheeks of the press frame by which the yoke on the drive side is connected nonstretchably with the yoke on the counterbearing side, a design of the press frame is obtained that is generally much thinner and also less prominent in the axial direction, with frame elongations resulting that are less than 50% of the frame lengths that would be added in a conventional design with comparable cross sections of the cheeks of the press frame in a press of conventional design. The reduction in the required installed electrical power for operating the pressure supply system of the press that can be achieved by this measure alone is considerable.

In addition, by designing the drive cylinder for the driving piston with a small-area "high-speed stage" and a large-area "load-piston stage" that can be cut in if necessary, combined with its movement being controlled by means of an overtravel-regulating valve that operates with electrically pulse-controlled incremental set position value determination and mechanical actual position value feedback, a travel-controlled change in press force appropriate for the requirement, and thus an especially efficient utilization of the installed driving power, is possible. In combination with the travel-regulated movement control of the driving cylinder piston with driving pressure monitoring by means of an electronic pressure sensor, embossing of coins with a uniform surface quality is possible for example even when the thickness of the blanks shows a relatively wide variation, since it is possible for example to determine, from a differentiating processing of the output signal of the pressure sensor, at which piston position the upper punch of the press strikes the blank, and so this position can be used as the reference position for the further embossing process, which can then be conducted with exact travel control incrementally corresponding to the profile depth to be achieved.

By comparison with the one-piece design of the press frame, which results in an optimum strength of said frame, the two-part design provided for the press frame has the advantage of a simpler manufacturability with equally good mechanical stability.

With the designs and arrangements of the driving cylinder piston combined with the design of the pressure supply system at a low output pressure level and a high output pressure level, favorable gradations in press forces can be achieved for press operation.

Preferred designs of a pressure supply system that can be used at two different output pressure levels are a system operating with a storage-charging technique that permits especially good utilization of the installed power.

Structurally simple and functionally favorable designs of hydraulic circuit and function elements of the press permit a rapid change between high-speed and load-stage operation of the driving cylinder, offer guidance of oil-equalization flows in short and low-resistance flow paths, a smooth and largely noiseless changeover from high-speed feed to load feed as well as from load feed to retraction of the working cylinder, and guarantee reliable operation of the press for a long period of time.

An ejector synchronous operation of the press such that a completely embossed medal, still clamped between the upper punch and the lower punch, can be lifted out of the embossing ring and grasped in the free working area of the press by a gripper before it is released by further lifting of the upper punch and lowering of the lower punch.

The press according to the invention can be designed for a maximum pressing force of $4\times10^6$N for example, with an intrinsic weight of only approximately 1% of this force and, by comparison with a conventional press, can be operated with an installed electrical driving power that corresponds to only approximately 30% of the power requirement of a conventional press.

The movement of the press tool and possibly the ejector as well is freely programmable, with any sequence of press cycles being achievable in theory, within which the press force, after an initial rise, decreases again, increases again, and decreases again, etc. and the peak values of the press force can be preset within the respective cycles. The pressure monitoring can equally well be used as a reference for the travel-controlled process of the press cycles by controlling the stepping motor of the travel-regulating valve. With such program-controlled operation of the press, because of the efficient switchability from high-speed to load-feed operation with an enlarged driving surface of the driving cylinder, comparatively high numbers of cycles can be reached. The press, however, lends itself to automatic pressure-controlled operation such that after the press tool strikes the blank, which can be detected by the pressure monitoring system from a rise in the driving pressure, a feed step pulse is triggered each time such that after an incremental feed step has taken place, the driving pressure that can be detected by the pressure sensor no longer changes, at least not significantly, so that in such an operating mode, the time that elapses between the issuance of successive control pulses increases steadily and the "final" embossed state of a coin for example can be detected when the increase in driving pressure remains constant or nearly constant from feed step to feed step, which can likewise be detected from an evaluation of the pressure sensor outward signal.

This type of control for an embossing process is especially suitable for providing information for optimized programming of serially performed embossing processes.

It is understood that the press, following suitable adaptation to the individual application, can also be used for embossing coins or medals in a so-called "free die", i.e. without an embossing ring, as well as for deep-drawing, extrusion, calibration, hobbing, and precision cutting.

BRIEF DESCRIPTION OF THE DRAWINGS

Further details of the press according to the invention will follow from the following description of a special embodiment with reference to the drawing.

DESCRIPTION OF THE PREFERRED EMBODIMENT

Figure 1:
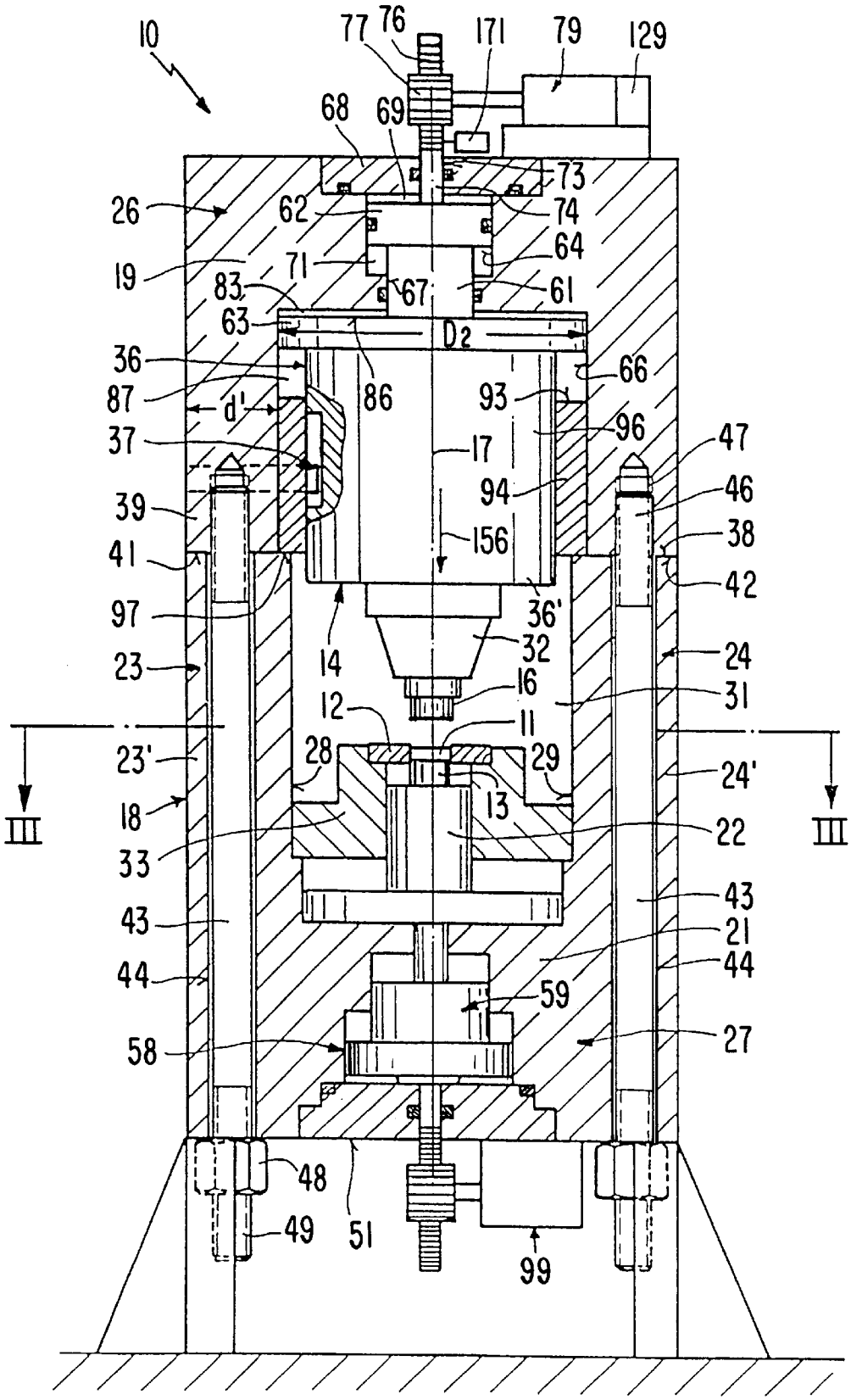
FIG. 1 is a general view of a press according to the invention, designed as a coin and medal embossing press, with a hydraulic driving cylinder and a hydraulically driven ejector, partially sectioned along a radial plane of the press that contains a central lengthwise axis of said press.
Figure 2:
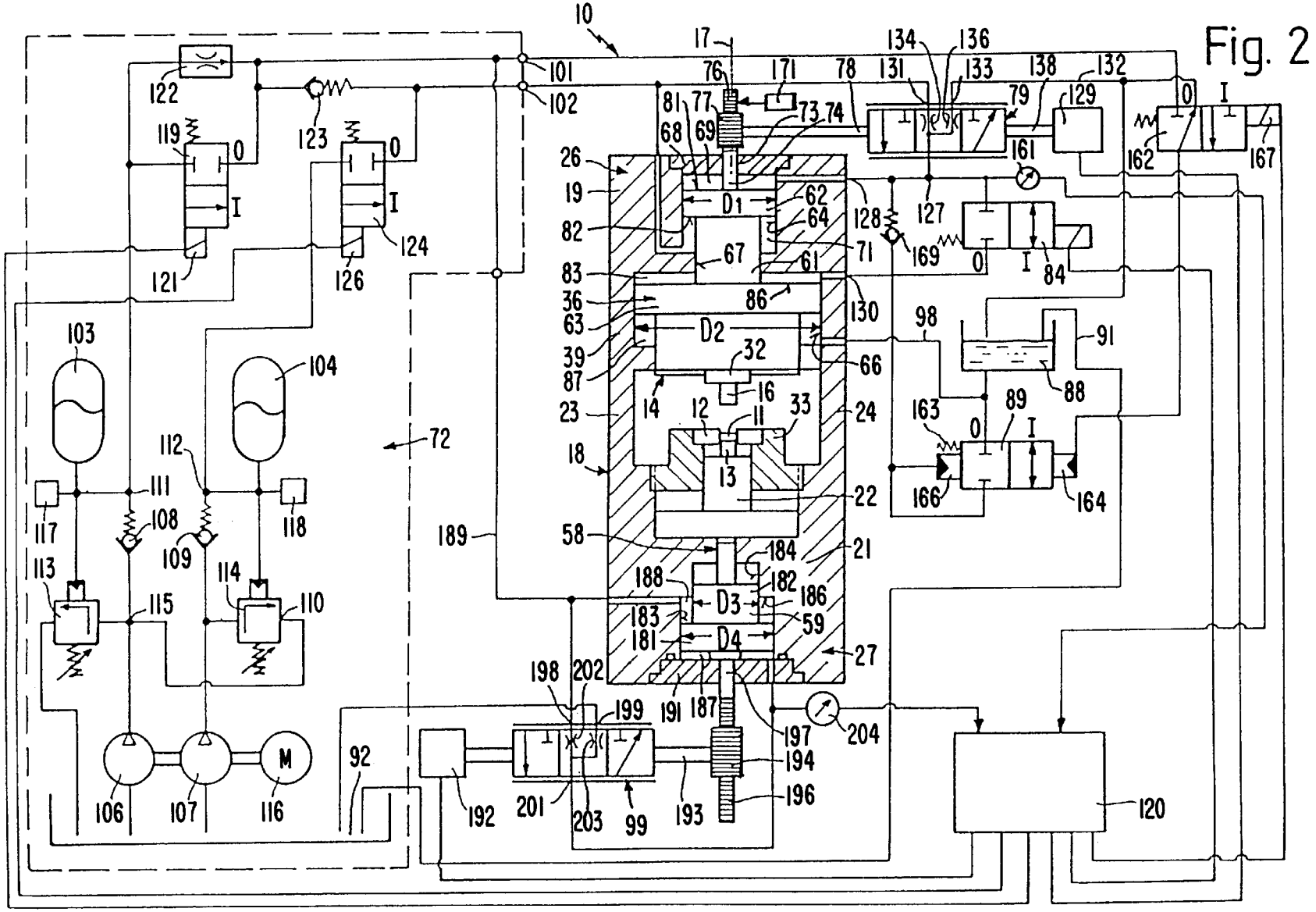
FIG. 2 is a hydraulic circuit diagram of the electrohydraulic control of the press according to FIG. 1 as well as the pressure supply system.

The press, designated in FIGS. 1 and 2 by 10 as a whole, is assumed for the purposes of explanation to be an embossing press suitable for embossing coins or medals with a high surface quality, in which flat-circular-disc-shaped blanks 11 for example, placed inside a coin ring 12 that forms the radial boundary of the embossing mold, can be embossed by cold working between a fixed lower punch 13 and a movable upper punch 16 that can be moved vertically by means of a driving hydraulic cylinder 14, said embossing resulting in flat-relief-type profiling of the obverse and reverse of the coin or medal and also in its edge profiling, which are determined by the matching designs of lower punch 13 and upper punch 16 a s well as coin ring 12.

Press 10 is designed as a vertical press with a vertically traveling central lengthwise axis 17, along which the high-speed and working feed movements directed toward and away from blank 11 as well as the return movements of upper punch 16 take place.

In a typical design of press 10, the latter is designed for a maximum embossing force of $4\times10^6$N that can be exerted on blanks 11.

Press 10 comprises a press frame, designated 18 as a whole, said frame being designed as a continuous frame that has a drive-side (upper) yoke 19 on which driving hydraulic cylinder 14 is supported axially, a yoke 21 on the counterbearing side on which lower punch 13 is supported axially by its punch holder 22 during the embossing process, with yoke 19 on the drive side being connected non-stretchably with counterbearing-side yoke 21 by cheeks 23, 24 and accepting the reactive forces that develop during the embossing process.

Press frame 18 comprises an upper frame part whose basic shape is that of a cylindrical pot, into which driving hydraulic cylinder 19 is integrated in such fashion that this frame part 26 forms the housing of drive cylinder 14 as well as a lower housing part 27 whose basic shape is that of a cylindrical block, from whose upper side two columns 23', 24' of equal height project upward, the cross sections of said columns being in the shape of segments of a circle and forming the lower sections of cheeks 23, 24 that connect yoke 19 on the drive side and yoke 21 on the counterbearing side with one another. The two columns 23', 24', with their flat internal boundary surfaces 28, 29 facing one another and located parallel to one another, form the lateral boundaries of window-shaped working area 31 of press 10 within which upper punch holder 32 that supports upper punch 16, coin ring 12, and massive supporting ring 33 that supports ring 12, as well as lower punch 13 and lower punch holder 22 supporting punch 13 are located and easily accessible. Lower frame part 27, including its columns 23', 24', is designed to be symmetrical with respect to vertical lengthwise central plane 34 of press frame 18 that runs between the two inner plane boundary surfaces 28, 29 and contains central axis 17.

Apart from a straight guide 37, provided to prevent piston 36 of drive cylinder 14 from twisting in its housing and shown only schematically, said guide comprising a guide piece that engages a lengthwise groove of piston 36 in a slidably positive manner and is mounted integrally with the housing, the same applies also to upper frame part 26 that forms the housing of drive cylinder 14 and yoke 19 of press frame 18.

Upper frame part 26, which has the same outside diameter (D+2d) as lower frame part 27, has annular plane end face 38 of its annular cylindrical jacket 39 resting on plane circular-segment-shaped end faces 41, 42, running at right angles to central lengthwise axis 17 of the press frame, of the two upwardly projecting columns 23', 24' of lower frame part 27 and is permanently connected with the latter by a total of four pretensioned tie rods 43, with the total pretensioning of these tie rods 43 corresponding to approximately twice the maximum embossing force that can be delivered by drive cylinder 14, said embossing force having to be accepted by press frame 18 with minimal deformation thereof and distributed uniformly over the four tie rods 43. In the embodiment chosen for the explanation, in which press 10 develops a maximum embossing force of $4\times10^6$N, each of the tie rods 43 is therefore pretensioned with $2\times10^6$N.

Tie rods 43, as may be seen from the drawing in FIG. 1, are drawn as elongated tension rods that pass through continuous bores 44 of lower housing part 27 that run inside the cross sectional area of columns 23', 24' of lower housing part 27, and are anchored by threaded end sections 46 in the anchoring threads of upper frame part 26, said threads being cut in blind holes 47 made in the free end of housing jacket 39. The pretensioning of tie rods 43 is maintained by clamping nuts 48 which mesh with threaded sections 49 of tie rods 43, provided for tensioning tie rods 43 and projecting from the underside of lower frame part 27, and abut lower boundary surface 51 of lower frame part 27.

Figure 3:
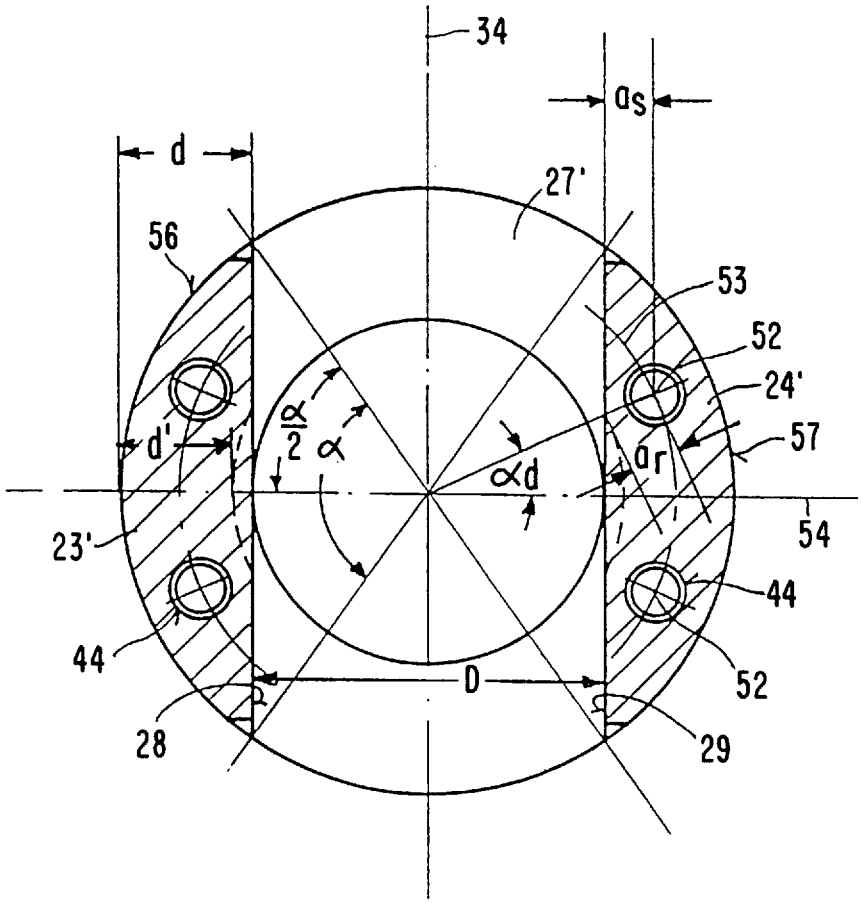
FIG. 3 is a section along line III—III in FIG. 1.

Central axes 52 of through bores 44 of lower frame part 27 and threaded blind holes 47 corresponding to them in upper frame part 26, as shown in FIG. 3, lie on a hole circle 53 whose radius r has the value r=D/2+d'/2, where D represents the distance between columns 23' and 24', d represents the maximum radial thickness, and d' represents the thickness of jacket 39 of upper frame part 26 that has the shape of a cylindrical pot.

The arrangement of through bores 44 of lower frame 27 is symmetrical with respect to the vertical transverse central plane of lower frame part 27 that extends at right angles to plane boundary surfaces 28, 29 of columns 23', 24'.

The azimuthal distance $\alpha_d$, the largest possible one that could be selected in practice which central axes 52 of through bores 44 can have, measured from vertical transverse central plane 54, is determined by the arrangement of bores 44, with the distance ($a_S$), measured at right angles to the plane boundary surfaces 28 and 29 of columns 23' and 24', of the respective central bore axis 52 from this plane boundary surface 28 or 29 being equal to the radial distance ($a_r$) of the respective central axis 52 from the outer cylindrical jacket surface 56 or 57 of column 23' or 24'. This naturally assumes that the diameter of tie rods 43 and that of bores 44 traversed by said tie rods is approximately equal to the value of the abovementioned distances $a_s$ or $a_r$, so that sufficient material is present between bores 54 and the respective boundary surfaces 28, 29 and 56, 57. Depending on the value of the ratio d/D in which d represents the maximum thickness of columns 23', 24' measured in transverse central plane 54, the values of azimuthal distance $\alpha_d$ of central bore axes 52 from transverse central plane 54 reach between 20° and just 40°, which is sufficient for a good distribution of the pretensioning forces that act in press frame 18.

An ejector designated as a whole by 58 is integrated into yoke area 21 of lower frame part 27, said ejector in turn being designed as a double-acting linear hydraulic cylinder whose piston, designated as a whole by 59, engages lower punch holder 22 and can be extended upward for a distance such that the embossed coin or medal can be disengaged from coin ring 12.

To explain the drive concept of press 10 and its functional properties, reference will again be made to the hydraulic diagram in FIG. 2, in which, with reference to FIGS. 1 and 3, as far as its structural design is concerned, structural and functional elements already explained have been given the same reference numerals as in FIGS. 1 and 3, with this also being intended to incorporate a reference to their description with reference to this figure.

Piston 36 of hydraulic cylinder 14 provided as a power drive has two piston flanges 62, 63 permanently connected with one another by a piston rod 61, said flanges having different diameters $D_1$ and $D_2$ and being displaceably guided in a pressure-tight manner in bore stages 64, 66 of correspondingly different diameters, with piston rod 61 passing displaceably in a pressure-tight manner through a central through bore 67 that connects the two bore stages 64, 66 with one another.

Within bore stage 64, which is inserted according to the drawing in FIGS. 1 and 2 from above into cylindrical-pot-shaped frame part 26 and has a smaller diameter, said stage 64 being closed pressure-tight by a housing lid 68, an upper driving pressure chamber 69 is delimited movably in a pressure-tight fashion by means of piston flange 62, which is smaller than diameter $D_1$, from a lower annular driving pressure chamber 71 that is traversed axially by piston rod 61, into which the currently prevailing output pressure of the pressure supply system designated as a whole by 72 is permanently coupled, said system being designed for operation with different values for the maximum output pressure.

A slender piston rod 64 of driving piston 36 of drive cylinder 42 is brought out through a central bore 73 of housing lid 68, the free end 76 of said cylinder being designed as a rack by whose downward and upward movements, performed during operation of press 10, a gear 77 is drivable in alternate rotational directions, with a threaded spindle 78 being non-rotatably connected with said gear, said spindle in turn being a functional element of a mechanical feedback device of a travel-regulating valve 79 provided for controlling the movement of upper punch 16 of press 10, said valve operating with electrically-controllable setting of the set value of the position of driving cylinder piston 36 or upper punch 16 and with mechanical feedback of the actual position value by rack drive 76, 77.

By means of this travel-regulating valve 79, which will be described in further detail below with respect to its function, upper driving pressure chamber 69 defined in an axially movable fashion by smaller piston flange 62 can be alternately pressurized and depressurized.

The area $A_1$ of annular surface 81 on which smaller piston flange 62 is exposed to a pressure that is coupled into upper driving pressure chamber 69 is larger by a factor of 2 than the area $A_2$ of annular surface 82 of smaller piston stage 62 on which the latter is exposed to the output pressure from pressure supply system 72 prevailing in lower annular driving pressure chamber 71 that is likewise defined in an axially movable fashion by smaller piston stage 62.

By means of larger piston flange 63, displaceable in a pressure-tight fashion in larger bore stage 66 of upper frame part 26 of driving cylinder piston 36, an additional annular driving pressure chamber 83, axially traversed by piston rod 61 that connects the two piston flanges 62 and 63 with one another, is defined axially movably, into which chamber, likewise by means of travel regulating valve 79 and a surface-connecting valve 84 located downstream therefrom, pressure is couplable by which larger piston flange 36 can be urged against an annular surface 86 whose area $A_3$ is much larger than the area $A_1$ of upper annular surface 81 of smaller piston stage 62, while in a typical design of press 10, the ratio A1:A3 is approximately 1:8.

A zero-pressure annular chamber 87 is also defined movably in a pressure-tight fashion by larger piston flange 63 from annular driving pressure chamber 83, said chamber 87 being filled with hydraulic oil and being maintained in constantly communicating connection with an overtravel chamber represented symbolically as "supply container 88", said chamber being located designwise above larger driving pressure chamber 83 and connectable by a delayed-flow valve 89 capable of opening up a larger flow cross section, with driving pressure chamber 83 delimited over a large area.

The overtravel chamber is connected by an overflow line 91 with supply container 92 of pressure supply system 72 and has a receiving capacity that corresponds at least to the total of the maximum oil volumes that can be received by upper driving pressure chamber 69, said chamber being sealed by housing lid 68 and driving pressure chamber 83 that is defined over a large area and traversed axially by piston rod 61, by whose exposure to pressurization high-speed and load-feed movements of piston 36 of driving hydraulic cylinder 14 directed toward and away from workpiece 11 can be controlled.

The housing-integral axial delimitation of zero-pressure annular chamber 37, as is best seen from FIG. 1, is formed by upper annular face 93 of a sliding sleeve 94 inserted into bore stage 66 with large diameter $D_2$ in a pressure-tight and non-displaceable fashion, in which sleeve driving piston 36 is guided displaceably in a pressure-tight manner by a piston rod 96 that traverses sliding sleeve 94 axially, with the diameter of this piston rod 96, which also projects by a short end section 36' into working chamber 31 of press 10 in the uppermost end position of driving piston 36, being only slightly smaller than the lateral spacing D of upwardly projecting columns 23', 24' of lower frame part 27, said spacing in turn being slightly smaller than diameter $D_2$ corresponding to the outside diameter of sliding sleeve 94 of larger bore stage 66 so that the sleeve has the marginal areas of its lower annular face 97, in the shape of segments of a circle, vertically abutting plane end faces 41, 42 of columns 23', 24'.

The volume of hydraulic oil expressed from zero-pressure annular chamber 87, said chamber being connected directly with overtravel chamber 88 through an outflow line 98, corresponds to approximately ⅓ to ½ of the volume of hydraulic oil that enters annular driving pressure chamber 83 defined over a larger area when piston 36 performs its high-speed feed and/or load-feed stroke directed at blank 11.

Before moving on to discuss the control of pressing and embossing processes by means of travel-regulating valve 79, surface-connecting valve 84, and delayed-flow valve 89, as well as an additional travel-regulating valve 99, provided for controlling ejector 58, details of the design and construction of pressure supply system 72 should be discussed, said system ensuring a pressure supply to press 10 at two different output pressure levels, 70 and 280 bars for example, and accordingly having a low-pressure supply outlet 101 and a high-pressure supply outlet 102 at which however the lower output pressure of 60 bars can also be provided.

Pressure supply system 72 comprises a low-pressure reservoir 103 and a high-pressure reservoir 104, each of which is chargeable by means of a hydraulic pump 106 or 107 and through a reservoir-charging valve 108 or 109 designed as a check valve, said valves 108 or 109 moving into their open positions and otherwise performing a blocking action as a result of higher pressure at the pressure outlet of the corresponding pump 106 or 107 than at supply connection 111 or 112 of low-pressure reservoir 103 or high-pressure reservoir 104.

The pressure level to which the respective pressure reservoir 103 or 104 can be charged is determined in each case by a pressure-limiting valve 113 or 114 with an adjustable pressure limit value. The two hydraulic pumps 106, 107 have a common electric-motor drive 116 that is switched on whenever the output pressure level of at least one of the two pressure reservoirs 103, 104 has fallen to a value that is 5% lower for example than the pressure limit value established by the respective pressure-limiting valve 113 or 114, and is switched off again as soon as this value is undershot.

The type of automatic control of pump drive 116 used here is illustrated by two pressure switches 117, 118 with adjustable hysteresis.

Output 110 of pressure-limiting valve 114 that determines the output pressure level of high-pressure reservoir 104 is connected with input 115, connected to the pressure outlet of low-pressure pump 106, of pressure-limiting valve 113 that determines the output pressure level of low-pressure reservoir 103, said valve 113 therefore being connected hydraulically in series with pressure-limiting valve 114 of high-pressure reservoir 104.

This hydraulic series connection of the two pressure-limiting valves 113, 114 creates a situation in which, in the course of the charging phases of low-pressure reservoir 103, during which high-pressure reservoir 104 does not require charging, hydraulic pump 107 associated with said reservoir 104 also works to charge low-pressure reservoir 103.

A first pressure supply control valve 119 is connected between supply connection 111 of low-pressure reservoir 103 and low-pressure supply outlet 101 of pressure supply system 72, said valve 119 being designed as a 2/2-way solenoid valve that has a spring-centered blocking basic position 0 and, when its control magnet 121 is controlled by an output signal from an electronic control unit 120 provided for operational control of press 10, can be switched into through-flow position I in which supply connection 111 of low-pressure reservoir 103 is connected directly with low-pressure supply outlet 101 of pressure supply system 72 and therefore the output pressure of low-pressure reservoir 103 can be provided at this low-pressure supply outlet 101.

A current volume regulator 122 designed as a pressure-compensated throttle is connected in parallel with first pressure supply control valve 119 designed as a 2/2-way solenoid valve, through which regulator 122, even when pressure supply control valve 119 is in its blocking basic position 0, a hydraulic oil stream that is smaller in volume can flow firstly to low-pressure outlet 101 of the pressure supply system and secondly through a check valve 123 to high-pressure outlet 102 of pressure supply system 72 as well, said check valve being controlled to move into its open position by a relatively higher pressure at low-pressure outlet 101 than at high-pressure outlet 102, said valve otherwise performing a blocking action.

Pressure supply system 72 also comprises a second (high-) pressure supply control valve 124 designed as a 2/2-way solenoid valve, said valve 124 being connected between supply connection 112 of high-pressure reservoir 104 and high-pressure outlet 102 of pressure supply system 72.

The spring-centered basic position 0 of this second pressure supply control valve 124 is its blocking position, and the excited position I assumed when its control solenoid 126 is excited by an output signal from electronic control unit 120 is its through-flow position, in which supply connection 112 of high-pressure reservoir 104 is connected with high-pressure outlet 102 of pressure supply system 72, but the latter, because of the blocking action of check valve 123, is shut off from low-pressure supply control valve 119 and current volume regulator 122.

So long as both pressure supply control valves 119 and 124 assume their blocking basic positions 0, the output pressure of low-pressure reservoir 103 is applied to both pressure outlets 101 and 102 of pressure supply system 72, and can be used for an oil flow, limited by flow volume regulator 122, for "slow" manually-controlled emergency operation of the press. In the operationally ready state of press 10 and its pressure supply system 72, with low-pressure supply control valve 121 open and high-pressure supply control valve 124 closed, the output pressure of low-pressure reservoir 103 with high hydraulic power can be used at both pressure outlets 101, 102 of pressure supply system 72, since current volume regulator 122 is bridged by supply control valve 119.

If the second supply control valve 124 of pressure supply system 72 is also simultaneously switched into its through-flow position I, the output pressure of high-pressure reservoir 104 is provided at high-pressure outlet 102 of pressure supply system 72, while the output pressure of low-pressure reservoir 103 is still available at low-pressure output 101.

In contrast to driving cylinder 14 of press 10, whose pressure supply comes through high-pressure outlet 102 of pressure supply system 72, so that driving cylinder 14 can be supplied optionally at the low output pressure level of low-pressure reservoir 103 or the high output pressure level of high-pressure reservoir 104, ejector 58 is supplied with pressure exclusively through low-pressure outlet 101 of pressure supply system 72.

In the design of pressure supply system 72 described above and the arrangement of driving cylinder 14 of press 10, the press can be utilized in four different operating modes corresponding to the values $F_{max1}$ to $F_{max4}$ of the maximum achievable embossing force, namely:

1. Adjustment of pressure supply system 72 to a low-output pressure level at pressure supply outlet 102 and control of the pressing or embossing force of press 10 exclusively by coupling the pressure medium of travel-regulating valve 79 into upper driving pressure chamber 69 defined by smaller piston stage 62 of piston 36 of driving cylinder 14, while annular driving pressure chamber 83 defined by larger piston stage 63 remains at zero pressure and hydraulic oil from overtravel chamber 88 can continue flowing into driving pressure chamber 83 through delayed-flow valve 89 that has been switched to its through-flow position I. Since annular space 71 defined in an axially movable fashion by smaller piston flange 62 is permanently connected to pressure supply outlet 102 of pressure supply system 72, at which low output pressure $p_N$ or high output pressure $p_H$ is optionally provided, in this operating mode of the press the maximum embossing force $F_{max1}$ that can be developed by said press is provided by the equation:

$$F_{max1}=(A_1-A_2)\times p_N \quad (1)$$

2. The operating mode is explained in the same way as under paragraph 1 above as far as the exclusive use of smaller piston flange 62 for driving control of press 10 is concerned, but pressure supply system 72 is operated at higher output pressure level $p_H$ at pressure supply outlet 102, so that we have the following relationship for the maximum valve $F_{max2}$ of the embossing force that can be exerted:

$$F_{max2}=(A_1-A_2)\times p_H \quad (2)$$

3. Pressure supply system 72 is set for operation with a low output pressure level $p_N$ at pressure supply outlet 102, but the delivery of the pressing force is controlled by the coupling of the pressure into both upper driving pressure chamber 69 movably defined by smaller piston flange 62 and into driving pressure chamber 83 movably defined by larger piston flange 63 of piston 36 of driving cylinder 14, said chamber 83 being traversed axially by piston rod 61 that connects its two piston flanges 62 and 63 with one another, with the maximum value $F_{max3}$ of the embossing force that can be achieved being provided by the equation:

$$F_{max3}=(A_3\times P_N+(A_1-A_2)\times p_N \quad (3)$$

in this operating mode of press 10.

In this operating mode, in the phase in which pressure is coupled into driving pressure chamber 83 defined by a large area, surface-connecting valve 84 is switched from its blocking basic position 0 to its through-flow position I, in which control connection 127 of travel-regulating valve 79, permanently connected to supply connection 128 of upper driving pressure chamber 69 of driving cylinder 14 movably defined by smaller piston flange 62, is also connected with supply connection 130 of driving pressure chamber 83 which is annular and defined in an axially movable fashion by larger piston flange 63, while in this pressure buildup operating phase, delayed-flow valve 89 is switched back into its blocking basic position 0 and as a result supply connection 128 of driving pressure chamber 83 defined by the larger area is shut off from overtravel chamber 88.

4. Control of embossing force development as explained under 3.0 above but utilizing high-output pressure level $p_H$ at pressure supply outlet 102 of pressure supply system 72.

The maximum value $F_{max4}$ in this operating mode of press 10 is provided by the following equation:

$$F_{max4}=A_3\times p_H+(A_1-A_2\times p_H) \quad (4)$$

To explain a special and preferred design of press 10, it is assumed that pressure supply system 72 can be used at a low output pressure level $p_N$ of 70 bar and a high output pressure level $p_H$ of 280 bar. A valve of 200 $cm^2$ is assumed for effective area $A_1$ of smaller piston flange 62 by which upper driving pressure chamber 69 is movably defined, and a value of 100 $cm^2$ is assumed for annular "counter" area $A_2$ while a value of 1500 $cm^2$ is selected for area $A_3$ of larger piston flange 63, by which the latter movably defines driving pressure chamber 83. With this assumed design of press 10, the values of 70 kN, 280 kN, 1120 kN, and 4480 kN, which have a ratio of $1:4:4^2:4^3$ to one another, are obtained for the maximum values $F_{max1}$ to $F_{max4}$ of the press forces that can be achieved in the various operating modes, disregarding frictional forces.

Such an exponential ranking of the maximum values $F_{max1}$ to $F_{max4}$ in the general case can be achieved for the case in which a certain ratio $Q = A_3/(A_2-A_1)$ of the effective piston flange areas of piston 36 of driving cylinder 14, by virtue of the fact that for the ratio $q=p_H/p_N$ of the usable output pressures of pressure supply system 72 the value $$q = \sqrt{(Q+1)} \tag{5}$$

is set for example by an appropriate adjustment of the limiting values of pressure limiting valves 113 and 114 and for the case in which the ratio $q=p_H/p_N$ of the usable output pressures of pressure supply system 72 is set, the area ratio $Q=A_3/(A_2-A_1)$ of the abovementioned "drive" surfaces 81 ($A_1$), 82 ($A_2$), and 86 ($A_3$) is set to the following value:

$$Q=q^2-1 \tag{6}$$

The travel-regulating valve 79 provided to control the high-speed and load-feed movements of driving cylinder piston 36 for upper punch 16 of press 10, with the design of said valve 79 being assumed to be known, so that a detailed structural explanation of this valve including the nature of its electrical control by means of an electrical stepping motor or an AC motor 129 to specific position settings of drive cylinder piston 36 as well as the position actual value feedback through rack drive 76, 77 and feedback spindle 78 does not appear necessary, is designed in this embodiment as a 3/3-way proportional valve which, by controlling set value setting motor 129 in alternate rotational directions, can be controlled to assume alternate functional positions I and II associated with the alternate movement directions, "downward" and "upward," of driving cylinder piston 36 of driving cylinder 14 of press 10.

In basic position 0 of travel regulating valve 79 shown, its p-supply connection 131, permanently connected to both high and low output pressure levels $p_H$ and $p_N$, the T-supply connection 133 linked through a return line 132 with overtravel chamber 88, and the control connection 127 permanently connected with supply connection 128 of upper driving pressure chamber 69 of driving cylinder 14 are linked with one another through an input throttle 134 and an output throttle 136 with a high flow resistance, so that this basic position 0 of travel-regulating valve 79 also acts as a blocking position in which control output 127 of travel-regulating valve 79 is shut off from both its p-supply connection 131 and also from its T-supply connection 133, but regulating processes that require only small volume flows are still possible.

A design and form are specified for travel-regulating valve 79 within known versions, for which reference will now be made to the semi-schematic representation in FIG. 4. In this case, the travel-regulating valve is assumed to be a slide valve, whose valve body is represented by the 3/3-way valve symbol. Within the housing of said valve, indicated primarily by p-supply connection 131, T-supply connection 133, and control connection 127 of valve 79, said housing being mounted in a fixed position and, in the embodiment shown, mounted on drive-side yoke 19 of press frame 18, the valve body of travel-regulating valve 79 is rotatable parallel to the common central lengthwise axis 137 of drive shaft 138 of stepping motor 129 of a hollow shaft 139 drivable by the latter, and threaded spindle 78 is mounted on a fixed housing element 141 of the housing of travel-regulating valve 79 so that it is rotatable but nondisplaceable axially and can thus move back and forth, as a result of which travel-regulating valve 79 can be controlled to assume its alternate through-flow positions I and II.

In its end facing the stepping motor, hollow shaft 139 has an internal straight toothing 141 that engages, meshing with zero play but slidable axially, with a complementary outer straight toothing 142 of drive shaft 138, with hollow shaft 139 being rotationally drivable and capable of being slid back and forth axially relative to drive shaft 138 of stepping motor 129.

Figure 4:
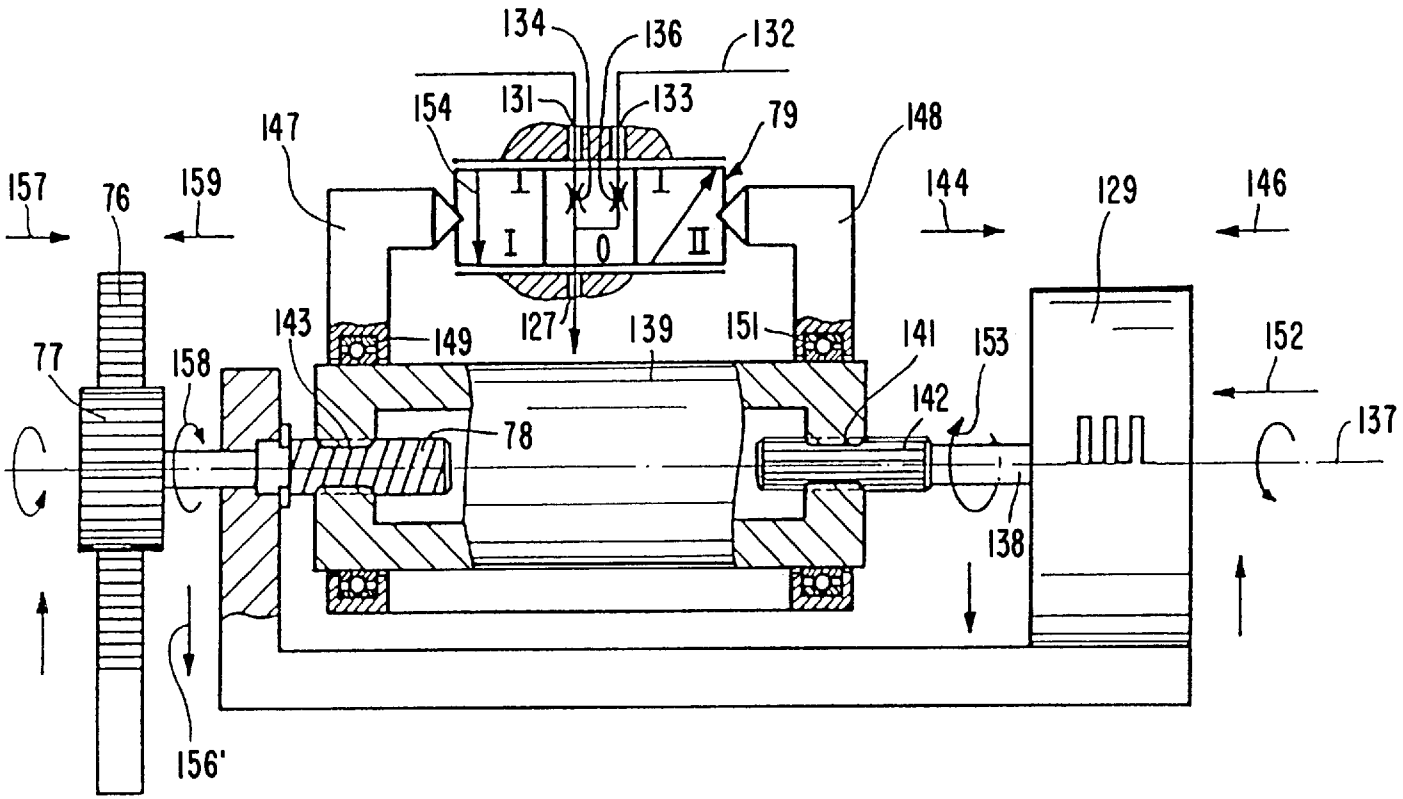
FIG. 4 is a semi-schematic sectional diagram of a travel-regulating valve provided within the framework of the press control in FIG. 2.

At its end facing away from drive shaft 138 of stepping motor 129, the hollow shaft is provided with an internal thread 143 that matches the thread of threaded spindle 178, by means of which thread 143 it engages threaded spindle 78, meshing with zero play and assumed to be non-self-locking, with the thread of spindle 78 having a large pitch, 10 mm/turn for example, so that hollow shaft 139, when making one revolution relative to threaded spindle 78, also undergoes an axial displacement of 10 mm with respect to said spindle, depending on the direction of rotation of the stepping motor, in the direction of arrow 144 or in the direction of arrow 146 in FIG. 4.

To transmit the axial reciprocating movements of hollow shaft 139 to the valve body of travel-regulating valve 79, actuating elements 147 and 148 are provided on the opposite ends of said valve 79 and engage the latter positively, said elements each being connected nondisplaceably with hollow shaft 139 by means of a ball bearing 149 or 151, but decoupled from the rotational movements of said shaft 139, and protected against rotation by their positive engagement with the valve body of travel-regulating valve 79.

Travel-regulating valve 79 is designed so that its valve body undergoes a shift in the direction of arrow 144 in FIG. 4, in other words, to the right in this drawing, when stepping motor 129, looking in the direction of arrow 152 in FIG. 4, is controlled to perform a rotation of its drive shaft 138 in the direction of arrow 153, in other words a rotation in the clockwise direction, assuming that threaded spindle 78 is standing still, so that the travel-regulating valve enters its functional position I in which T-connection 133 of travel-regulating valve 79 is disconnected from overtravel chamber 88 and control connection 127 of travel-regulating valve 79 is connected with the pressure supply connection 102 of pressure supply system 72 by a through-flow path 154, opened in this functional position I of travel-regulating valve 79, whose cross section, with increasing deflection of the valve body in the direction of arrow 144 in FIG. 4, increases in proportion to the latter, at which connection 102, depending on the control of pressure supply valves 119 and 124 of pressure supply system 72, the low or high output pressure $p_N$ or $p_H$ is applied, intended to operate press 10.

Due to the resultant pressurization of at least upper driving pressure chamber 69, defined in an axially movable fashion by smaller piston flange 62 of driving cylinder piston 36, driving cylinder piston 36 is displaced in the direction of arrow 156 in FIG. 1 directed toward blank 11 to be embossed and leads to a displacement, in the direction of arrow 156', of rack 76 permanently connected with driving cylinder piston 36, from which a rotational drive, looking in the direction of arrow 157 in FIG. 4, of gear 77 of rack drive 76, 77 results, causing threaded spindle 78 to rotate in the direction of arrow 158 in FIG. 4, in other words counter-clockwise, so that hollow shaft 139 then undergoes a displacement in the direction of arrow 159 in FIG. 4, as a result of which the valve body of travel-regulating valve 79 is again moved in the direction causing it to return to its "blocking" basic position 0, with which the stopping of driving piston 36 of driving hydraulic cylinder is linked.

The speed with which drive piston 36 moves against blank 11 in the direction of arrow 156', provided hydraulic oil can flow sufficiently rapidly through travel-regulating valve 79, is determined by the frequency of the control pulses by which stepping motor 129 is controlled, with an incremental rotation of the rotor of stepping motor 129 by the same angular amount with each pulse.

Thus, a momentary value of the set position of drive cylinder piston 36 is determined by the number of control pulses supplied to stepping motor 129 since the beginning of the movement of drive cylinder piston 36 by which its actual position lags behind an overtravel that corresponds to the amount of deflection of the valve body of travel-regulating valve 79 from its basic position 0, divided by the translation ratio of rack drive 76, 77.

When the output of position set value pulses with which stepping motor 129 is controlled ends, the feedback device of travel-regulating valve 79, which is mechanical and comprises rack drive 76, 77 and feedback spindle 78, causes valve 79 to be reset to its basic position 0, with drive piston 36 approaching the set position specified by the last control pulse of the stepping motor at a speed that decreases exponentially. This applies for as long as upper punch 16 of press 10 has not yet struck blank 11.

If upper punch 16, in the course of a feed movement of drive piston 36 of drive cylinder 14 as described above, strikes the blank, thus causing its cold working to begin, since blank 11 opposes the feed movement of drive piston 36 by an increased resistance, this leads to an increase in overtravel and an increase in pressure in upper driving pressure chamber 69 of the driving hydraulic cylinder, since driving piston 36 can no longer follow the position set value setting sufficiently rapidly.

To monitor the pressure $p_V$ prevailing in upper drive pressure chamber 69 during the feed operation of hydraulic cylinder 14, a pressure sensor 161 is provided that generates an electrical output signal that is supplied to electronic control unit 120, said signal, depending on its level and/or frequency, being an unambiguous measurement of pressure $p_V$ prevailing in upper driving pressure chamber 69, and capable of being evaluated as such by electronic control unit 120.

Delayed-flow valve 89 is designed as a 2/2-way valve with spring-centered blocking position 0 as its basic position, said valve being switchable hydraulically by an electrically controllable precontrol valve 162 into its switching position I, its through-flow position, with the pretensioning of its valve spring 163, by which delayed-flow valve 69 is urged into its basic position 0, being small relative to the switching force that urges delayed-flow valve 89 into its switch position I, its through-flow position, when one of its control chambers 164 is subjected to control pressure through precontrol valve 162 and its other control chamber 166 is simultaneously at zero pressure, said chamber 166 being in a permanently communicating connection with driving pressure chamber 83 of driving cylinder 14, said chamber 83 being defined in an axially movable fashion by larger piston flange 63 of drive cylinder piston 36 and defined in an axially movable fashion by a control surface that is larger in size than control chamber 164 that is hydraulically controllable by precontrol valve 162, with the ratio of the areas in this case being approximately 6:1.

Precontrol valve 162 is designed as a 3/2-way solenoid valve, in whose spring-centered basic position 0 the control chamber 164 defined by the smaller area of delayed-flow valve 89 is connected with T-connection 133 of travel-regulating valve 79 or directly with supply container 92 of the pressure supply system, and low-pressure outlet 101 of pressure supply system 72 is cut off from the abovementioned control chamber 164 of delayed-flow valve 89. By exciting its control solenoid 167 with an output signal from electronic control unit 120, precontrol valve can be switched into a switching position I in which control chamber 164 of delayed-flow valve 89, delimited by the smaller area, is exposed to the output pressure prevailing at low pressure outlet 101 of pressure supply system 72 and this control chamber 164 is cut off from T-connection 133 of travel-regulating valve 79 or supply container 92 of pressure supply system 72.

The surface-connecting valve 84 is designed as an electrically controllable 2/2-way solenoid valve with a spring-centered blocking basic position 0, which can be controlled by exciting its control solenoid 168 with an output signal from electronic control unit 120 into its through-flow position provided as switch position I, in which control terminal 127 of the travel-regulating valve is also connected with driving pressure chamber 83, delimited by a large area, of driving hydraulic cylinder 14 in a communicating fashion.

A return valve 169 is connected in parallel with surface-connecting valve 84, said valve 169 being designed in the special embodiment shown as a check valve controlled into its open position by a relatively higher pressure in driving pressure chamber 83 delimited by a larger area of driving hydraulic cylinder 14 than in its upper driving pressure chamber 69 delimited by the smaller area, into its open position and otherwise in a blocking position. Through this return valve 169, in the upward movement phases of drive cylinder piston 36, by which for example only the pressure exerted on coin 11 is to be reduced, hydraulic oil can flow from driving pressure chamber 83, delimited by the large area, of driving cylinder 14 and through the travel-regulating valve located in its functional position II in such a phase, to overtravel chamber 88, even if delayed-flow valve 89 is in its blocking basic position 0 and surface-connecting valve 84 likewise assumes its blocking basic position 0.

With a typical arrangement of travel-regulating valve 129 provided for drive control of driving hydraulic cylinder 14, its stepping motor can be controlled by a sequence of 4000 control pulses to perform a complete 360° rotation of its drive shaft 138, in other words, to perform an incremental rotation of 0.09 degree per control pulse. With a likewise typical circumference of 40 mm for gear 77 of rack drive 76, 77 of mechanical position actual-value feedback device 76, 77, 78, 139 of travel-regulating valve 79, this corresponds to an accuracy of 1/100 mm for the position set value setting as well as its feedback and hence also to an adjustability of the stroke of drive piston 36 of driving hydraulic cylinder 14. Based on a profile depth of 0.5 mm for the coin or medal to be embossed on the front and back of the medal, this means that the stroke of drive cylinder piston 36 required to produce the desired embossing is controllable to an accuracy of 1% when (a) it is known at what value of the embossing force press 10 can deliver the coin or medal to be embossed can be considered to have been embossed;

(b) this embossing force must be adjustable with sufficient accuracy.

Condition (a) can be determined in simple fashion by trial or calculation. Condition (b) can be met, likewise in simple fashion, by the design of travel-regulating valve 79.

Press 10 is therefore adjustable within a wide range of dimensions of coins or medals to be embossed for optimum values of its stroke and/or embossing force, and can be controlled with high accuracy.

The embossing of a coin or a medal by press 10 is controlled manually or automatically, for example as follows:

Proceeding on the basis that blank 11 is located resting in its position within coin ring 12 and on lower punch 13, ready for embossing, and drive cylinder piston 36 together with upper punch 16 is in its upper end position in which the distance between blank 11 and the lower punch is 6 cm for example, the operating mode explained in Section 1 is chosen first for the initial phase of an embossing cycle, in which mode lower output pressure $p_N$ is provided at both pressure supply outlets 101 and 102 of pressure supply system 72. Precontrol valve 162, controlled by an output signal from electronic control unit 120 to switch to its functional position I, so that outflow valve 89 is switched into its through-flow position I, in which overtravel chamber 88 is connected with driving pressure chamber 83 of driving cylinder 14 defined by the large area, so that hydraulic oil can flow from the latter into overtravel chamber 88 as soon as drive piston 36 is displaced toward blank 11. The press is now ready for operation, controllable by means of travel-regulating valve 79, in the operating mode explained under paragraph 1. The travel-regulating system is activated, but as long as stepping motor 129 is not controlled by position set value setting pulses, drive piston 14 remains in its upper end position, which is a regulated position in which the pressure prevailing in upper drive pressure chamber 69 of drive cylinder 14, defined by smaller piston flange 62, not including in the calculation the intrinsic weight of the drive cylinder piston 36 and losses due to friction, as a result of the area ratio $A_1$: $A_2$, corresponds to half the value of the pressure prevailing in annular chamber 71 movably defined by smaller piston flange 62, in other words, half of the output pressure provided at pressure supply outlet 102 of pressure supply system 72.

If stepping motor 129 is controlled with "forward" control pulses, so that travel-regulating valve enters its functional position I, the pressure in upper drive pressure chamber 69 is increased slightly by an amount $\Delta p_N$, whereupon the feeding movement of drive piston 36 directed at blank 11 begins. The speed with which drive piston 36 moves downward can be determined by the frequency with which the electrical control pulses are produced in stepping motor 129. In order to achieve embossing cycle times that are as short as possible in an automatically controlled embossing operation, a frequency is advantageously chosen that is so high that the volume flow that can be provided at pressure supply outlet 102 of pressure supply system 72 is utilized as fully as possible to achieve a piston speed that is as high as possible in this phase of high-speed feed.

During this high-speed feed operation of press 10, at least an major part of the distance is traversed that separated upper punch 16 in the initial position from blank 11 to be machined.

If an initiation of the embossing process that is as gentle as possible is to be achieved, for low-noise operation of press 10 for example, the output frequency of the stepping motor control pulses is reduced or interrupted for a short time before upper punch 16 strikes blank 11 and is then continued at a low frequency so that upper punch 16 strikes blank 11 correspondingly slowly.

When this is the case, a pressure rise begins in upper driving pressure chamber 69 of drive cylinder 14, with the absolute value of this pressure, which can be detected by pressure sensor 161, being a direct measure of the embossing force acting on blank 11.

The initial signal of pressure sensor 161 can therefore be utilized to end the output of control pulses to stepping motor 129 when a predetermined value of the embossing pressure or embossing force is reached that has previously been determined to be optimal for the type of coin to be produced.

With the aid of pressure sensor 161, an especially rapid course of an embossing process can be controlled in such fashion that high-speed feed operation of the drive cylinder until upper punch 16 strikes blank 11, and even thereafter, is continued until the output signal of pressure sensor 161 exceeds a threshold value that can be set in advance and as a result the frequency with which control pulses for stepping motor 129 are output is reduced, and when the most favorable value of the embossing force for embossing the respective type of coin has been reached, the output of "forward" control pulses for stepping motor 129 is terminated.

As a result of this pressure-controlled reduction of the output frequency of control pulses for the stepping motor and its termination, a result is achieved such that, regardless of the thickness of the blanks, which is subject to tolerances, the quality of the coins or medals produced by the automatically controlled embossing processes remains constant.

Both in embossing controlled exclusively by the number of control pulses delivered to stepping motor 129 and in embossing controlled by the output signals of pressure sensor 161, the count of the control pulses whose sum in the embodiment explained above is in step widths of 1/100 mm, apart from the respective travel distance of drive cylinder piston 36, is a measure of its current position starting at the moment at which the drive cylinder piston, after beginning its downward movement, passes an upper reference position which for example can be detected by an electronic position sensor 171 or switch, by means of which the position of the upper, free end of rack 76 of rack drive 76, 77 provided for feedback of the actual position value to travel regulating valve 79 can be determined exactly for example.

The position of drive piston 36 or upper punch 16 of press 10 determined by electronic control unit 120 on the basis of the output control pulses is then always based upon this reference position determined by electronic position sensor 171.

Figure 5A:
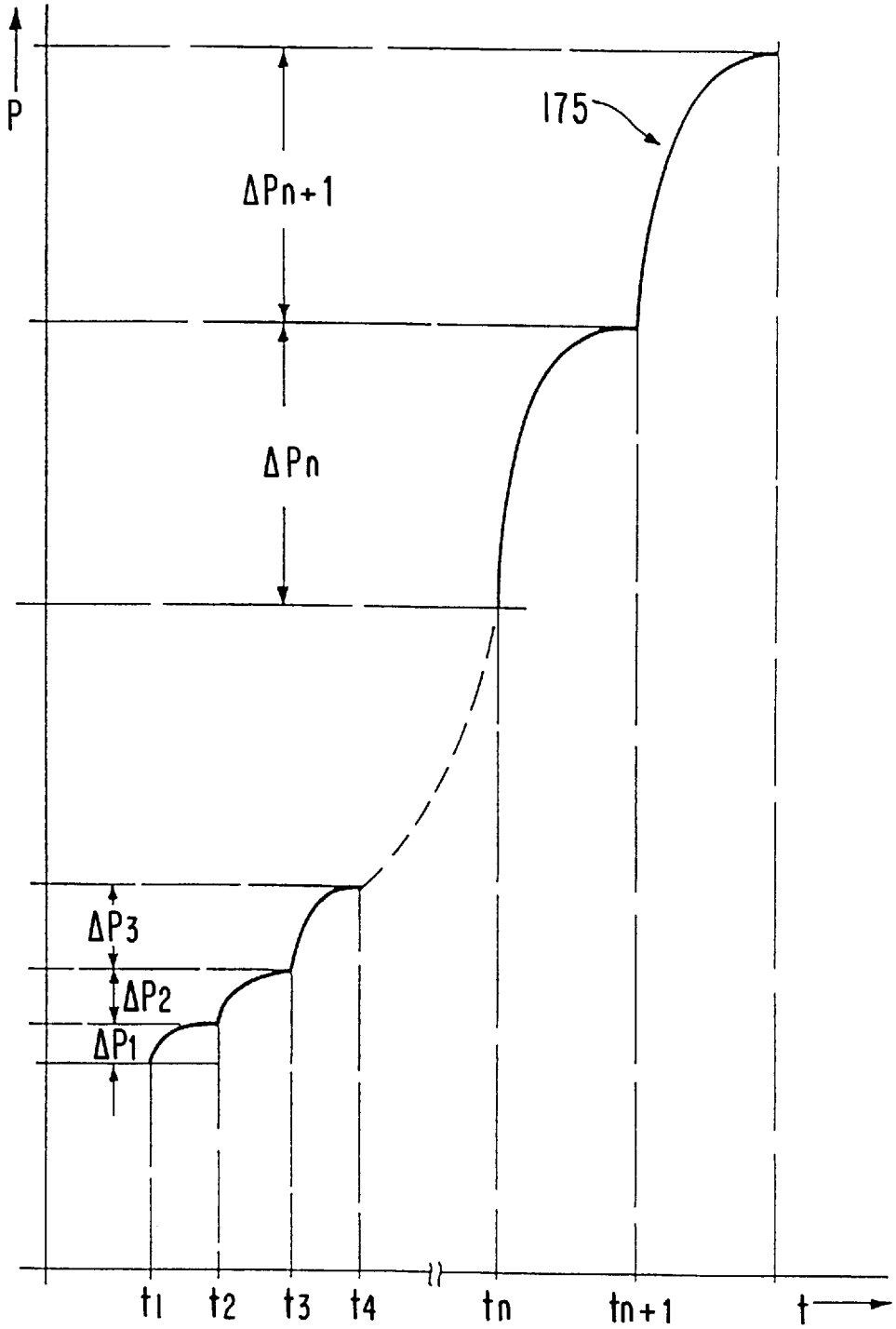
FIGS. 5*a* and 5*b* each show a graph explaining the function of the press according to FIG. 1.

To explain the functional properties specific to press 10, which from the above-described type of motion control of drive piston 36 according to the travel control principle in combination with a continuous measurement of the pressure in upper driving pressure chamber 69 of driving hydraulic cylinder 14, with which, in the event that the latter is also operated with pressurization of its driving pressure chamber 83 defined by the larger area, is identical to the pressure prevailing in the latter and can be detected by means of the same pressure sensor 161, see in this connection considerably simplified schematic graph 175 in FIG. 5*a*, in which the development over time of the pressure prevailing in upper driving pressure chamber 69 and/or in driving pressure chamber 89 of driving hydraulic cylinder 14, is plotted, said chamber being defined by the larger area, with the pressure being plotted on the ordinate and detectable by means of pressure sensor 161 that results qualitatively after upper punch 16 has struck blank 11, which could have been the case at time $t_1$ in the graph in which time is plotted on the abscissa. Furthermore, it is assumed that beginning at this point in time $t_1$, when electronic control unit 120 recognizes from its differentiating processing of the output signal of pressure sensor 161 that a sudden pressure increase is beginning, the output frequency of the control pulses to stepping motor 129 is reduced to the point where time interval $\Delta t$ which elapses until the next control pulse by which stepping motor is controlled in a "forward direction" is delivered at time $t_2$ is made sufficiently long that after expiration of time interval $\Delta t$, travel-regulating valve 79, after being controlled at point in time $t_1$ to enter its functional position I by an opening stroke determined by the position set value setting, has again reached or nearly reached its blocking basic position at point in time $t_2$, which the electronic control unit recognizes from the fact that the controlled driving pressure in drive chamber(s) 69 and/or 83 is no longer changing, which is equivalent to travel-regulating valve 79 having again reached its basic position 0 and is also equivalent to embossing having begun with a depth that corresponds to the step width of the feed travel of drive cylinder piston 36 linked with a control pulse.

The pressure increase $\Delta p_1$ linked to the first "embossing" pulse is relatively small, since the material of the blank that is enclosed in the space defined by lower punch 13, embossing ring 12, and upper punch 16 still has a relatively large amount of space into which it can expand, said space decreasing with each forward step of upper punch 16. Accordingly, the pressure changes $\Delta p_2$, $\Delta p_3$, etc. linked with each of the additional embossing steps that are triggered at points in time $t_2$, $t_3$, etc. increase in amount until finally the configuration of the coin or medal to be produced that corresponds to a uniform three-dimensional filling of the space defined by the embossing tools by the material of the blank is reached, and therefore no further shape change in said blank is any longer practically possible.

In view of the fact that this situation is achieved by the last "forward" control pulse delivered to stepping motor 129 prior to point in time $t_n$ for pressure increases $\Delta p_n$ and $\Delta p_{n+1}$ that appear as a consequence at points in time $t_n$ and $t_{n+1}$ triggering further forward control pulses for stepping motor 129, the same or approximately the same values are obtained which approximately correspond to the pressure increase that followed the last control pulse that led to an embossing deformation of blank 11.

The constant nature of pressure changes $\Delta p_n$ and $\Delta p_{n+1}$, etc. that follow stepwise control of stepping motor 129 follows from the fact that after the coin has been embossed, drive cylinder 14 can also cause an elastic expansion of press frame 18 that produces a reactive force proportional to this expansion and hence to constant values of the pressure increase per feed step.

Hence, by monitoring pressure increases $\Delta p_i$ (i=1, 2, . . . , n, n+1), it is therefore possible to determine the embossed state of the blank to be processed and also to determine what pressure is required to emboss a coin or medal of a predetermined size and profile depth using press 10.

The embossing process described with reference to FIG. 5*a* can be controlled automatically in such fashion that a control pulse for the stepping motor is triggered (only) after a feed motion step of drive piston 36, triggered by a previous control pulse, has been completed.

This halt can be determined by time differentiation of the output signal of pressure sensor 161 or by time differentiation of the output signal of position sensor 171, if the latter is designed for continuous detection of the position of drive cylinder piston 36, or also by the output signal of a position sensor, not shown, with which the deflections of the valve body of travel regulating valve 79 out of its basic position can be detected.

Figure 5B:
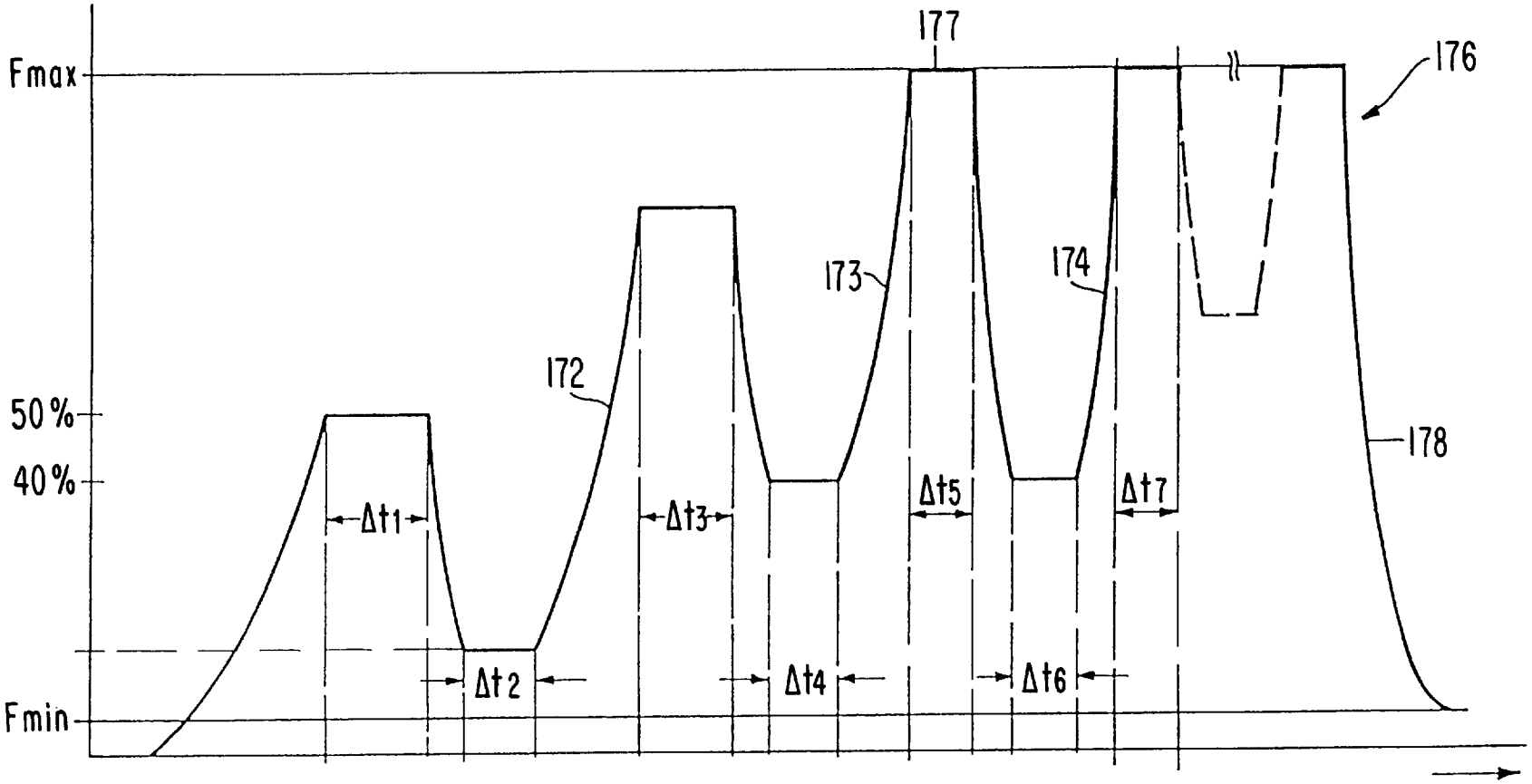

The embossing process of a medal with high surface quality that requires an embossing force equal to $F_{max}$, determined for example by an embossing process, as explained in terms of its basic idea with reference to FIG. 5*a*, can be controlled with press 10, as is also illustrated by diagram 176 in FIG. 5*b*, in such fashion that the embossing process is distributed over several embossing cycles, in which the blank is exposed to different maximum values of the embossing force.

In the embossing process, illustrated by graph 176 in FIG. 5*b*, in which the embossing force is plotted on the ordinate and the time is plotted on the abscissa, in a first cycle the embossing force is raised to approximately 50% of the maximum value $F_{max}$ and then kept constant for a time $\Delta t_1$. Then the embossing force is reduced to a low value of 10 to 15% of the maximum embossing force for example and held for a relaxation interval with a duration $\Delta t_2$ at the low value. Then the embossing force, corresponding to the second rising branch 172 of F/t graph 176, is increased once again until a value of the embossing force, kept constant relative to the first, with a higher value of 80% for example of the maximum embossing force $F_{max}$ is reached. The embossing force is again held constant for an embossing interval $\Delta t_3$ and then reduced to a value that is lower than the value of the embossing force reached in the first embossing cycle, but higher than the value to which the embossing force was lowered in the first embossing cycle. In the example shown, the embossing force is reduced to approximately 40% of the maximum embossing force $F_{max}$ and then held constant at the low value for a relaxation interval with a duration $\Delta t_4$. After this relaxation interval has elapsed, the embossing force is increased to its maximum value $F_{max}$ and kept constant for the duration of embossing interval $\Delta t_5$, as represented by the third rising branch 173 of F/t graph 176 and section 177 of the F/t curve parallel to the abscissa, running at the level of the maximum embossing force $F_{max}$. After the third embossing time interval $\Delta t_5$ has elapsed, the embossing force is reduced again and held at approximately the same low value for a third relaxation interval $\Delta t_6$ at which the third embossing cycle was started. This embossing cycle is followed by at least one additional cycle in which the embossing force, as represented by the fourth rising branch 174 of graph 176, is again increased to its maximum value $F_{max}$ and held for an embossing interval with a duration of $\Delta t_7$.

To end the embossing process, which can take place after this fourth embossing cycle and possibly after additional embossing cycles of the type described, the force exerted by driving cylinder 14 on the medal that is now completely embossed, according to the last declining branch 178 of F/t graph 176, is reduced to a minimum value $F_{min}$ smaller than the force that can be provided by ejector 58 and directed upward, which must be applied to move the finished medal out of embossing ring 12 into working area 31 of press 10, where for the first time the medal is released from the press and removed by means of a gripper, not shown.

Ejector 58, designed as a double-acting differential cylinder, whose ejection and return strokes can be controlled by travel-regulating valve 99, must be able to develop an ejecting or expelling force of at least 10 kN, which is required for the case in which, after completion of an embossing process, upper punch 16 has been lifted off the embossed coin or medal and the latter need only be pushed out of embossing ring 12 so it can be removed by means of the gripper of press 10.

Advantageously, however, ejector 58 is designed for a much higher value of the maximum expulsion force, equal to the amount that can be delivered in the embossing operation of the press, when the latter is running in its operating mode as described under Section 1 above, in other words, in the embodiment chosen for the explanation, the press can deliver an expulsion force of 70 kN, which suffices if necessary to push back drive piston 36 of press drive cylinder 14, while the embossed coin or medal is still located between bottom punch 13 and upper punch 16, against a downwardly directed force produced by relatively low pressure exerted by upper driving pressure chamber 69 of drive cylinder 14.

Accordingly, drive piston 59 of ejector 58 is designed as a stepped piston that has a piston stage 181 with a larger diameter and a piston stage 182 with a smaller diameter, by which drive piston 59 is displaceably guided in a pressure-tight manner in bore stages 185 and 183 with correspondingly different diameters $D_1$ and $D_3$ which, separated from one another by a radial shoulder 186, are introduced from below into the part that forms counterbearing-side yoke 21 of press frame 18, while diameter $D_3$ of piston stage 182 with a smaller diameter and arc 184 receiving the latter correspond to the diameter of central through bore 67 through which piston rod 61 passes and which links piston flange 62 of drive piston 36 of driving hydraulic cylinder 14 with a smaller piston flange 62 with its larger piston flange 63.

The annular driving pressure chamber 188 traversed axially by smaller piston stage 162, axially defined in an axially movable fashion by larger piston stage 181 and defined from the larger driving pressure chamber 187 located below the latter, is permanently connected by a supply line 189 to low-pressure supply outlet 101 of pressure supply system 72.

Driving pressure chamber 187, defined over a larger area, which can be pressurized or depressurized through travel-regulating valve 99, said chamber being sealed off in a manner integral with the housing by a housing lid 191, can be charged with driving pressure by travel-regulating valve 99 or can be depressurized into supply container 92 of pressure supply system 72, with travel-regulating valve 99, in view of its design as a 3/3-way valve, being controlled by a stepping motor 192 to control the position setting of piston 59 of the ejector, and its position actual value feedback device is designed with a gear 194 driving a feedback spindle 193, with a rack 196 meshing with said gear, said rack being made as the end section of a piston rod 197 permanently connected with piston 59 of ejector 58, said rod passing displaceably through housing lid 191 in a pressure-tight manner, with which rod travel-regulating valve 79 provided for controlling the feed and return strokes of drive piston 36 of driving cylinder 14 is completely analogous, and we can thus refer to the description of this travel-regulating valve 79 provided with reference to FIG. 4.

Pressure (P) supply connection 198 of travel-regulating valve 99 of ejector 58 is likewise permanently connected by supply line 189 with low-pressure outlet 101 of pressure supply system 72. The relief (T) connection 199 of travel-regulating valve 99 of ejector 58 is connected by a return line directly with supply container 92 of pressure supply system 72. Likewise, travel-regulating valve 99 provided for ejector 58, in its basic position 0 of control outlet 2 or 1 of travel-regulating valve 99 resulting in blocking, is connected with its P-supply connection 198 by an input throttle 202 and with a T-relief connection 199 by an output throttle 203.

To monitor the pressure coupled into lower driving pressure chamber 187 of ejector 58, delimited by the larger area, an electromechanical or electronic pressure sensor 204 is provided whose electrical output signal is an unambiguous measure of the pressure prevailing in lower driving pressure chamber 187 of ejector 58 and can be supplied as an information input to electronic control unit 120.

As a result of the motion control of ejector 58 by means of travel-regulating valve 99, it is possible to keep the completely embossed coin or medal between upper punch 16 and lower punch 13 of the press during its removal from embossing ring 12, and to bring it into a specified position in which it can be gripped by the gripper and held securely before drive cylinder 14 and ejector 58 are controlled to perform firstly an upward movement and then a downward movement, releasing the coin or medal so it can be removed from working chamber 31 of the press.

We claim:

1. A press for cold working of metal workpieces comprising:

a) a double-acting linear hydraulic power drive cylinder, said cylinder having a maximum operating pressure and developing forces, usable for shaping the workpieces, between $10^6$N and $10^8$N;

b) a continuous press frame for accepting reactive forces that develop during the operation of the press, said frame having a drive-side yoke with a side supporting the drive cylinder, and a counterbearing-side yoke with a side axially supporting the workpiece for machining inside the frame, said frame having non-stretchable cheeks connecting the yokes, said cheeks being located diametrically opposite each another with respect to a central longitudinal axis of the press; and c) a control valve system operable by output signals, and being one of program-controlled or manually triggerable, from an electronic control unit, for controlling motion of a piston of the drive cylinder; wherein d) a housing of the drive cylinder forms a drive-side yoke of the press frame and with partial areas of a housing jacket portions of said cheeks of the press frame, with a lateral distance D of the cheeks from one another being greater than a diameter of a piston rod of the drive cylinder;

e) a piston of the drive cylinder having a piston surface with an area $A_2$, said surface movably defining a driving pressure chamber, said area, during operation of press, being permanently exposed to output pressure of a pressure supply system, with a force $F_R=p\cdot A_2$ urging the piston away from the workpieces, as well as a piston surface $A_1$ that is larger in value than $A_2$, by exposure to depressurization, and load-shifting movements and return movements of the piston directed toward workpiece are controlled, and another, larger-area driving surface $A_3$ having additional exposure to pressure load-advancing movements of the piston of drive cylinder are controlled;

f) a travel-regulating valve for controlling feed and return stroke movements, said valve operating electrically, by pulse control of a stepping motor having controllable incremental position set values of the drive cylinder piston and a mechanical feedback of an actual position value of the drive cylinder piston with an application and relief of pressure on the piston surfaces $A_2$ and $A_3$ usable for feed operation controlled by the travel-regulating valve;

g) one of an electromechanical or an electronic pressure sensor delivering an output signal characteristic of pressure prevailing at a control output of the travel-regulating value, said output signal being supplied as an actual pressure signal to the electronic control unit controlling a setting of position set value.

2. A press according to claim 1, wherein the press frame surrounding the housing of the drive cylinder has a yoke, lateral cheeks, and counterbearing-side yoke made in one piece.

3. A press according to claim 1, wherein the press frame is made in two pieces, with two housing parts that are pot-shaped, said two housing parts being held together by a plurality of tie rods passing through bores in cheek sections, a total pretensioning of the plurality of tie rods totalling between 1.6 times and 2.5 times, a maximum force $F_{max}$ that can be delivered by means of drive cylinder of press.

4. A press according to claim 3, wherein a separating plane of the two housing parts runs between a circular edge of a jacket area of an upper housing part of the press, forming the housing of drive cylinder and the ends of cheek sections thereof projecting from a lower frame part.

5. A press according to claim 1, wherein the drive piston of the drive cylinder has two piston flanges of correspondingly different diameters, said flanges being connected releasably with one another by a piston rod and displaceably guided in a pressure-tight manner in coaxial bore stages of different diameters, with a piston being sealed off from a housing bore connecting the two bore stages with one another, with an upper drive pressure chamber within which a smaller piston flange is exposed to pressure essentially over an entire end surface with $A_1$ being defined further inside a bore stage with a diameter $D_1$, sealed off by a piston flange from the stage, from a driving pressure chamber in a form of an annular cylinder and traversed axially by the piston rod, within which a cylinder piston flange selectively is pressurized on annular surface $A_2$ and with an additional driving pressure chamber being defined in an axially movable fashion by piston flange of the drive piston with a diameter $D_2$ larger than $D_1$, said chamber being annularly cylindrical and traversed axially by the piston rod, within which chamber the drive piston is selectively pressurized over driving surface $A_3$.

6. A press according to claim 5, wherein a ratio of $A_1$:$A_2$ of the larger surface to the smaller surface of the smaller piston flange of the drive cylinder piston has a value between 4 and 1.4.

7. A press according to claim 5, wherein a hydraulic oil overtravel chamber kept at zero pressure, is located above driving pressure chamber defined by the larger piston flange of the drive cylinder, said driving pressure chamber containing a volume of hydraulic oil corresponding at least to a sum of stroke volumes of the larger and the smaller piston flanges of the drive cylinder piston and being connectable by a controllable delayed-flow valve that has a blocking basic position and, at switch position I, a through-flow position, with the driving pressure chamber of the driving cylinder being defined by the larger piston flange, and the hydraulic oil overtravel chamber being connected by an overflow line with supply container of the pressure supply system.

8. A press according to claim 7, wherein the delayed-flow valve is a switching valve, electrically precontrollable, pressure-controlled, and having a valve with a spring-centered blocking basic position and the open switching position I, said valve being controllable into its open position I by coupling to a low output pressure $p_N$ from a first control chamber by means of an electrically controllable precontrol valve.

9. A press according to claim 8, wherein the delayed-flow valve has a second control chamber having an exposure to pressure resulting in a force that urges delayed-flow valve into a basic position and in that the pressure that prevails in the drive pressure chamber of drive hydraulic cylinder defined by the large area is permanently coupled into this second control chamber.

10. A press according to claim 9, wherein a control area $F_1$ defines a first control chamber of the delayed-flow valve in an axially movable fashion having an exposure to low pressure under valve control resulting in the controlling force that urges delayed-flow valve into a through-flow position I, is smaller than a control area $F_2$ that define a second control chamber in an axially movable fashion, whose exposure to the pressure prevailing in the large drive pressure chamber of drive cylinder produces a counterforce pushing delayed-flow valve into a blocking basic position, with the ratio $F_1$:$F_2$ of control surface and having a value between 1:3 and 1:9.

11. A press according to claim 1, wherein a ratio $A_1$:$A_2$ has a value between 1:6 and 1:12.

12. A press according to claim 1, further comprising a pressure supply system operable at two different output pressure levels $P_N$ and $P_H$.

13. A press according to claim 12, wherein a ratio $P_H$:$P_N$ of higher output pressure level ($P_H$) to lower output pressure level ($P_N$) corresponds approximately to the value $$\sqrt{[A_3/(A_1 - A_2)] + 1}\ .$$

14. A press according to claim 13, wherein the ratio $P_H$:$P_N$ has a value of approximately 4.

15. A press according to claim 12, wherein the pressure supply system comprises a lower-pressure reservoir and a higher-pressure reservoir, said reservoirs being chargeable by pumps having a common electric motor drive to output a $P_N$ which is a lower pressure level and $p_H$ which is a higher pressure level settable as defined by pressure-limiting valves, and are connectable alternately by two pressure supply control valves controllable by output signals from the electronic control unit, to at least one pressure supply outlet.

16. A press according to claim 15, wherein an output of the pressure limiting valve which determines an output pressure level of the higher-pressure reservoir is connected with a pressure outlet of a low-pressure pump and with the input side of a reservoir-charging valve of the low-pressure reservoir.

17. A press according to one of claim 15, wherein a check valve connected between a pressure supply connection at which both the pressure $p_H$ and the pressure $p_N$ of pressure supply system is provided by a pressure supply control valve and is connected with a pressure supply connection at which only the pressure $p_N$ of the pressure supply system is provided by a supply control valve connected to the lower-pressure reservoir, said check valve being controlled by a higher pressure at high-pressure outlet than at low-pressure outlet of pressure supply system to move to a blocking position and is controlled by a relatively higher pressure at lower pressure supply connection than at high pressure supply connection to move into an open position thereof.

18. A press according to one of claim 15, wherein a flow-volume regulator is connected in parallel with a pressure supply control valve through which lower-pressure reservoir is connectable to two pressure outlets of the pressure supply system.

19. A press according to claim 12, wherein the pressure supply system has a pressure supply connection at which only the $P_N$ of the pressure supply system can be provided.

20. A press according to claim 11, further comprising an electrically controllable surface connecting valve, said surface connecting valve having a blocking basic position and being switchable under control of an output signal of an electronic control unit into a through-flow position I, in which a control connection of a travel-regulating valve is additionally connected with a supply connection of the driving pressure chamber, defined by a large area of the driving hydraulic cylinder.

21. A press according to claim 20, wherein a T-return connection of the travel regulating valve is connected to a return line that leads to an overtravel chamber and that a check valve is connected hydraulically in parallel as a return valve with said surface-connecting valve, said check valve being controlled by a control unit to enter its open position with a relatively higher pressure in driving pressure chamber, defined by larger areas, of drive hydraulic cylinder than at control connection of the travel-regulating valve, the travel regulating valve otherwise being in a blocking position.

22. A press according to claim 1, wherein an annular chamber is located below the driving pressure chamber of the driving hydraulic cylinder, said annular chamber being traversed axially by the piston rod of the driving cylinder piston that supports the upper tool, said driving pressure chamber being kept at zero pressure, filled with hydraulic oil, and in a constant communicating connection with the overtravel chamber located above the driving pressure chamber.

23. A press according to claim 22, wherein the annular pressure chamber at zero pressure is formed axially integrally with the housing by the upper end of a sliding sleeve inserted from below into a bore stage with diameter $D_2$.

24. A press according to claim 22, wherein an ejector comprises a drive a double-acting differential hydraulic cylinder, said double-acting differential hydraulic cylinder being controlled by an additional travel-regulating valve.

25. A press according to claim 24, wherein the ejector cylinder has an upper annular driving pressure chamber into which a lower output pressure $p_N$ or a higher outlet pressure $p_H$ of an pressure supply system is permanently coupled during operation, said cylinder having a lower driving pressure chamber defined by a larger area, in which the pressure is controllable by a travel-regulating valve having a supply connection connected to a pressure outlet of said pressure supply system to which annular driving pressure chamber of the ejector cylinder is connected.

26. A press according to claim 25, wherein driving surfaces formed by a larger piston stage of the ejector cylinder defining two driving pressure chambers in an axially movable fashion have identical dimensions as driving surfaces formed by the piston flange of the drive cylinder piston.

27. A press according to claim 24, wherein the ejector cylinder has an ejection force of up to 30% of the press force deliverable by the drive cylinder.

28. A press according to claim 24, wherein one of an electromechanical or electronic pressure sensor is provided for monitoring pressure prevailing in the larger driving pressure chamber of the ejector cylinder, the electrical output signal from the sensor being fed to the electronic control unit as an actual pressure value information signal.

* * * * *